US010069232B2

(12) United States Patent
Endo et al.

(10) Patent No.: US 10,069,232 B2
(45) Date of Patent: Sep. 4, 2018

(54) FEMALE TERMINAL AND FEMALE TERMINAL PRODUCTION METHOD

(71) Applicant: Dai-ichi Seiko Co., Ltd., Kyoto-shi, Kyoto (JP)

(72) Inventors: Takayoshi Endo, Shizuoka (JP); Hiroyuki Kurita, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/422,064

(22) Filed: Feb. 1, 2017

(65) Prior Publication Data

US 2017/0237191 A1 Aug. 17, 2017

(30) Foreign Application Priority Data

Feb. 16, 2016 (JP) ..... 2016-027394

(51) Int. Cl.
*H01R 13/11* (2006.01)
*H01R 13/187* (2006.01)
(Continued)

(52) U.S. Cl.
CPC ..... *H01R 13/111* (2013.01); *H01R 4/185* (2013.01); *H01R 13/187* (2013.01); *H01R 43/16* (2013.01); *H01R 13/113* (2013.01); *H01R 13/114* (2013.01)

(58) Field of Classification Search
CPC ... H01R 13/111; H01R 13/113; H01R 13/114; H01R 4/185
See application file for complete search history.

(56) References Cited

U.S. PATENT DOCUMENTS 4,834,681 A * 5/1989 Chaillot ..... H01R 13/113 439/852
5,186,664 A 2/1993 Abe
(Continued)

FOREIGN PATENT DOCUMENTS

EP 1544952 A1 6/2005
JP 1985-38840 B 9/1985
(Continued)

OTHER PUBLICATIONS

Notification of Reasons for Refusal (JP Patent Application No. 2016-027394); dated Jun. 30, 2017; 7 pages; Includes English Translation.
(Continued)

*Primary Examiner* — Briggitte R Hammond
(74) *Attorney, Agent, or Firm* — Howard & Howard Attorneys PLLC

(57) ABSTRACT

A female terminal includes a tube-shaped main body and an elastic contact plate supported inside the main body, possessing elasticity and extending from one opening toward another opening into which a male terminal is inserted. The elastic contact plate includes; a first section that faces the inner surface of the main body and is separated from the inner surface; a first contactor that is positioned on the other opening side of the first section and contacts the inner surface; a second section that extends in an arch shape toward the other opening from the first contactor; and a second contactor that is positioned on the other opening side of the second section and contacts the inner surface. The main body supports the elastic contact plate so the first contactor and the second contactor are able to slide on the inner surface. The first section is thinner than the second section.

4 Claims, 11 Drawing Sheets

(51) Int. Cl.
*H01R 4/18* (2006.01)
*H01R 43/16* (2006.01)

(56) References Cited

U.S. PATENT DOCUMENTS

| | | | | |
|---|---|---|---|---|
| 5,427,553 | A | 6/1995 | Tsuji | |
| 5,536,186 | A | 7/1996 | Watanabe | |
| 6,171,155 | B1 | 1/2001 | Miwa et al. | |
| 6,290,553 | B1 * | 9/2001 | Sato ..... | H01R 13/187 439/843 |
| 2014/0287635 | A1 | 9/2014 | Tsuji et al. | |

FOREIGN PATENT DOCUMENTS

| | | | |
|---|---|---|---|
| JP | 1994-009069 | | 2/1994 |
| JP | 2546255 | Y2 | 8/1997 |
| JP | 3408294 | B | 5/2003 |
| JP | 3468346 | B | 11/2003 |
| JP | 3620014 | B2 | 2/2005 |

OTHER PUBLICATIONS

Extended European Search Report (EP Application No./Patent No. 17154822.5-1801); dated Jun. 20, 2017; 11 pages.
Communication pursuant to Article 97(3) EPC (EP Application No. 17 154 822.5-1201); dated May 30, 2018.

* cited by examiner

FEMALE TERMINAL AND FEMALE TERMINAL PRODUCTION METHOD

CROSS-REFERENCE TO RELATED APPLICATION

This application claims the benefit of Japanese Patent Application No. 2016-027394, filed on Feb. 16, 2016, the entire disclosure of which is incorporated by reference herein.

TECHNICAL FIELD

This application relates generally to a female terminal and a female terminal production method.

BACKGROUND ART

A female terminal has been known from before in which a spring contact member (an elastic contact plate) is disposed inside the female terminal body in order to press against and hold a male terminal. For example, in Patent Literature 1 (U.S. Pat. No. 3,620,014), a method is disclosed in which this spring contact member is installed inside a female terminal body. In the method disclosed in Patent Literature 1, first a belt-shaped substrate is extended to a plate-shaped substrate comprising the female terminal, the belt-shaped substrate is bent, and a section corresponding to a spring contact member is formed. Next, the belt-shaped substrate is folded so that the section corresponding to the spring contact member abuts the plate-shaped substrate. Then, a section protruding to the outside is cut along the opening of the female terminal. Through this, the spring contact member is formed.

The spring contact member (elastic contact plate) of the female terminal disclosed in Patent Literature 1 comprises an arch-shaped section that contacts a male terminal, and an extending piece that extends from the end of the arch-shaped section toward an opening into which a male terminal is inserted and contacts the inner surface of the female terminal body. With this kind of female terminal, the entire surface of one of the surfaces of the extending piece preferably contacts the inner surface of the female terminal body. However, when forming the elastic contact plate through the above-described cutting process, there are cases in which the tip of the extending piece contacts the inner surface of the female terminal body through tension at the time of the cutting process. In such cases, when the male terminal is inserted into the female terminal, the position or surface area of the contact section of the elastic contact plate on the inner surface of the female terminal body changes in accordance with insertion of the male terminal, so pressure holding the male terminal is unstable. As a result, holding the male terminal with the appropriate pressure becomes difficult. In addition, due to variance in tension at the time of the cutting process, the shape of the end of the elastic contact plate, the contact position, the surface area and/or the like vary, so that variance in properties arises among products.

In consideration of the foregoing, an objective of the present disclosure is to provide a female terminal that can hold a male terminal with appropriate pressure, and a female terminal production method.

A female terminal according to a first aspect of the present disclosure includes:

a conductive, tube-shaped main body; and an elastic contact plate supported inside the main body, possessing conductivity and elasticity, and extending from one opening toward another opening into which a male terminal is inserted;

wherein the elastic contact plate comprises:

a first section that faces an inner surface of the main body and is separated from the inner surface;

a first contactor that is positioned on the other opening side of the first section and contacts the inner surface;

a second section that extends in an arch shape toward the other opening from the first contactor; and a second contactor that is positioned on the other opening side of the second section and contacts the inner surface;

wherein the main body supports the elastic contact plate so that the first contactor and the second contactor are able to slide on the inner surface; and the first section is thinner than the second section.

The first contactor may be such that a surface contacting the inner surface is bent.

The female terminal may further comprise two wings protruding from both sides near an apex of the second section extending in an arch shape;

and in the main body, holes may be provided for receiving the protruding two wings.

The female terminal may further comprise protrusions disposed near the one opening of the main body and pressing a surface of the first section that does not face the inner surface in the direction of the inner surface.

A female terminal production method according to a second aspect of the present disclosure includes steps of:

preparing a substrate comprising a plate-shaped section that is conductive and plate-shaped, and a belt-shaped section that is conductive and plate-shaped and extends from one side of the plate-shaped section;

forming a thin plate section by thinning a portion of the belt-shaped section of the substrate;

mountain-folding the vicinity of an end on a tip side of the belt-shaped section, of ends of the thin plate section;

forming in an arch shape a section on the tip side of the mountain fold section of the belt-shaped section;

bending the belt-shaped section so that the belt-shaped section faces the plate-shaped section, and causing the end of the section formed on the arch and the mountain fold section to abut the plate-shaped section;

causing the belt-shaped section to be supported on the plate-shaped section such that the sections of the belt-shaped section abutting the plate-shaped section are able to slide on the plate-shaped section;

forming the plate-shaped section into a tube shape so as to enclose the belt-shaped section; and cutting off a connecting section between the belt-shaped section and the plate-shaped section formed into the tube shape.

A female terminal production method according to a third aspect of the present disclosure includes steps of:

producing a main body that is conductive and tube-shaped;

producing an elastic contact plate that is conductive and comprises a plate-shaped section in which a portion of one side is missing, a curved section that is curved from an end of the plate-shaped section so as to form a convex surface, and an arch-shaped section that extends in an arch shape from the curved section;

causing the convex surface of the curved section and the end of the arch-shaped section to contact the inner surface, so that the side of the plate-shaped section faces an inner surface of the main body near one opening of the tube-shaped main body; and causing the elastic contact plate to be supported by the main body so that the sections in contact with the inner surface are able to slide on the inner surface.

BRIEF DESCRIPTION OF THE DRAWINGS

A more complete understanding of this application can be obtained when the following detailed description is considered in conjunction with the following drawings, in which.

DETAILED DESCRIPTION

Below, a female terminal and female terminal production method according an exemplary embodiment of the present disclosure are described with reference to the drawings.

A female terminal according to the exemplary embodiment is, for example, used as a terminal of a pin-type female connector for auto parts. A female terminal 1 according to the exemplary embodiment comprises a main body 10, a swage K and a spring contact member 20, as shown in FIG. 1.

Figure 1:
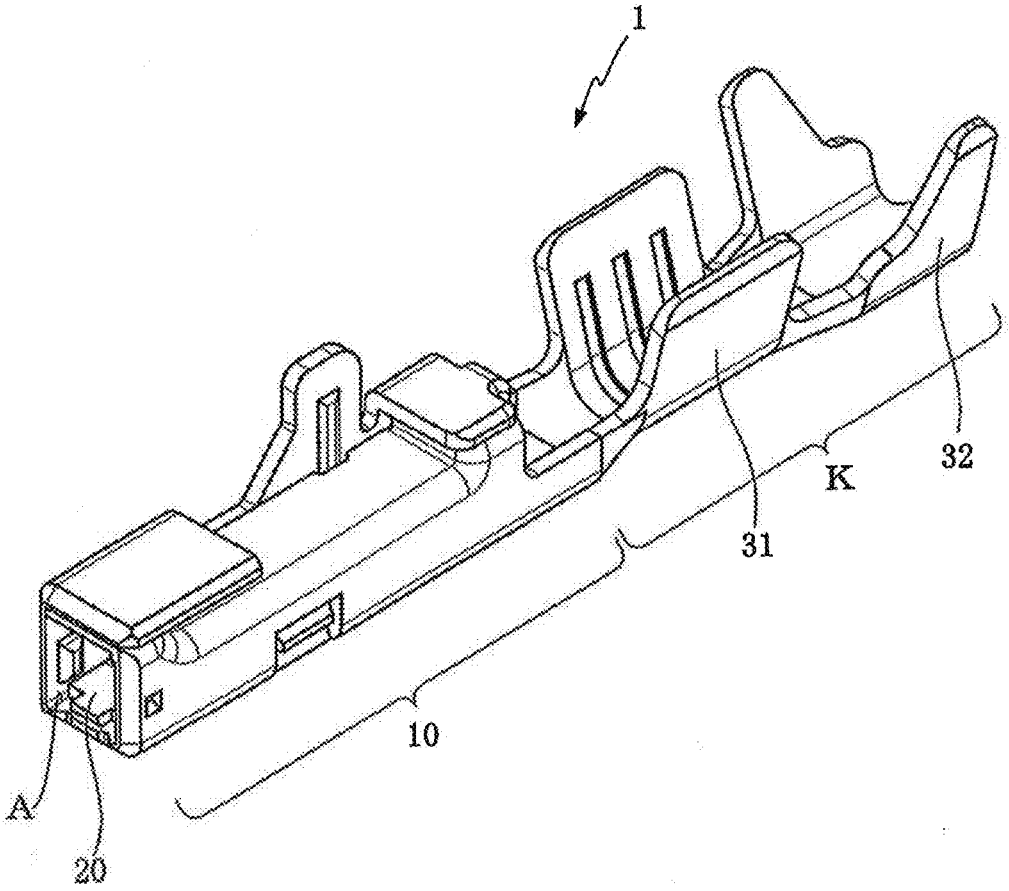
FIG. 1 is an oblique view of a female terminal according to an exemplary embodiment of the present disclosure.
Figure 2A:
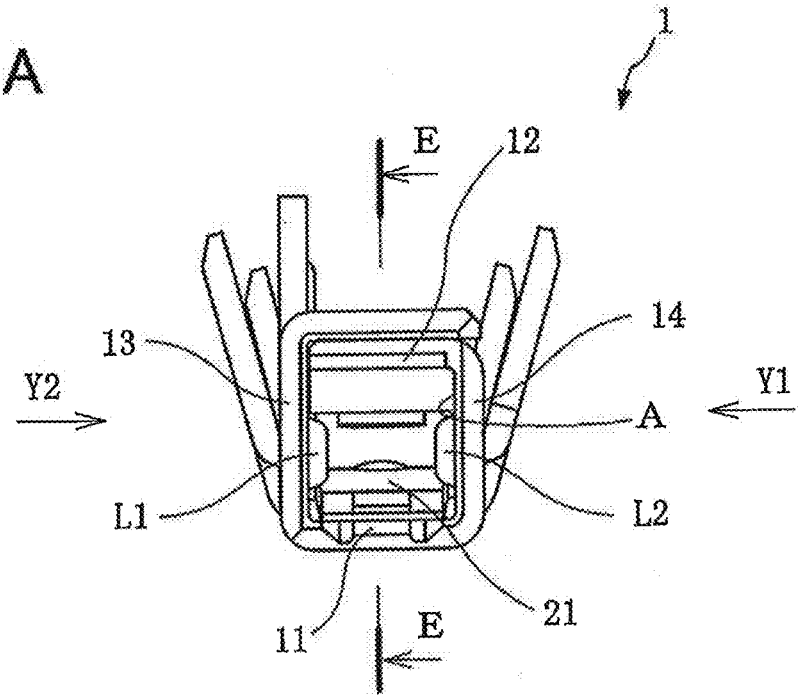
FIG. 2A is a frontal view of the female terminal shown in FIG. 1.

As shown in FIG. 1 and FIG. 2A, the main body 10 comprises an opening A into which a male terminal is inserted, and is formed into a square tube shape comprising a bottom plate 11, a top plate 12 and side plates 13 and 14. The main body 10 is made of electrically conductive materials such as copper, copper alloy and/or the like. Consequently, when a male terminal is inserted from the opening A, the male terminal and the female terminal 1 are electrically connected.

Figure 2B:
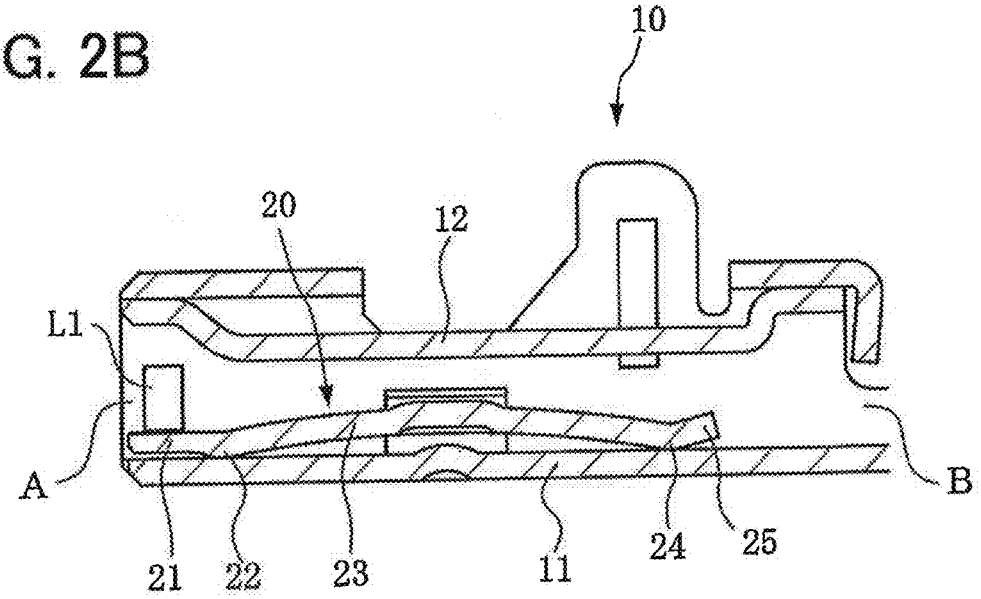
FIG. 2B is a cross-sectional view taken along line E-E in FIG. 2A.

The spring contact member 20 is positioned on the bottom plate 11, as shown in FIG. 2B.

The top plate 12 is formed in a convex shape directed toward the bottom plate 11. A male terminal inserted from the opening A is interposed between the top plate 12 and the spring contact member 20 positioned on the bottom plate 11.

Protrusions L1 and L2 are respectively provided near the opening A of the side plates 13 and 14, as shown in FIGS. 2A and 2B. The protrusions L1 and L2 push a below-described first section 21 of the spring contact member 20 toward the bottom plate 11. The protrusions L1 and L2 are formed at a size that does not impede insertion of a male terminal into the tube-shaped main body 10, and protrude in respectively opposing directions from the side plates 13 and 14.

Figure 3A:
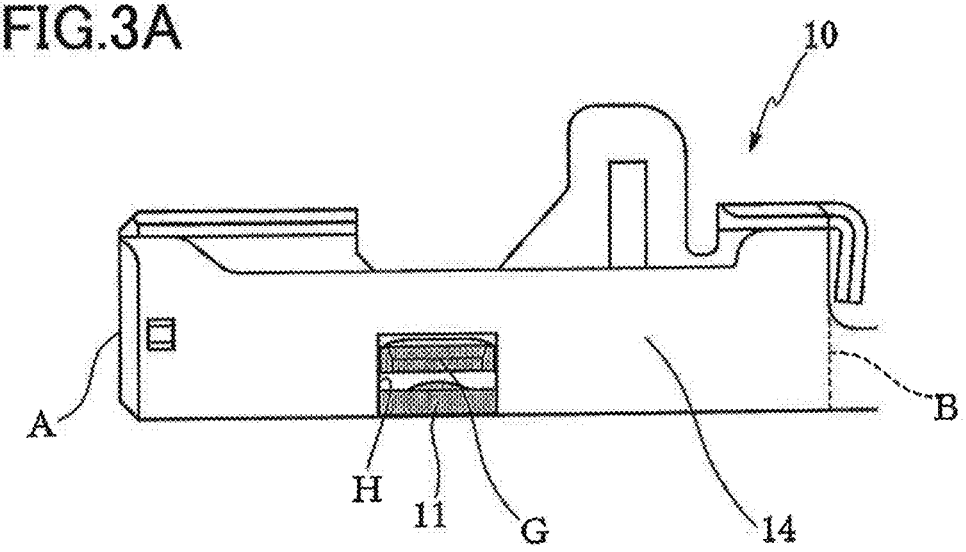
FIG. 3A is a side view of a female terminal main body as viewed from an arrow Y1 in FIG. 2A.
Figure 3B:
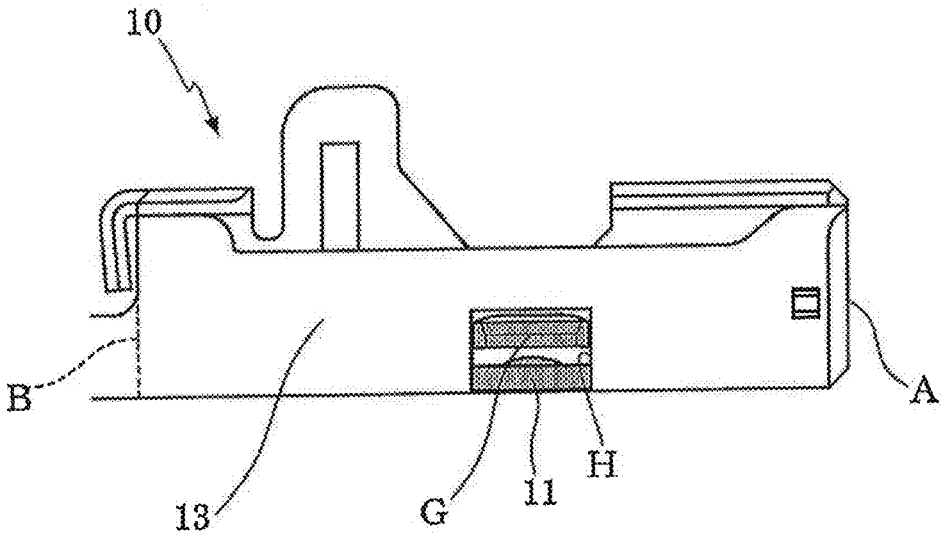
FIG. 3B is a side view of the female terminal main body as viewed from an arrow Y2 in FIG. 2A.

Holes H are respectively formed in the side plates 13 and 14, as shown in FIGS. 3A and 3B. The holes H receive wings G provided in a below-described second section 23 of the spring contact member 20, and swingingly supports the spring contact member 20. The wings G are formed such that the widths (the length in the left-right direction in FIG. 3) are slightly smaller than the widths (the length in the left-right direction in FIG. 3) of the holes H.

The swage K comprises a conductor swage 31 and a covering fixer 32, as shown in FIG. 1. The conductor swage 31 is pressure bonded, and electrically connected, to the tip of a core wire of an insulator covering wire by swaging. The covering fixer 32 presses the end of the insulator covering wire by swaging and protects the connection between the conductor swage 31 and the core wire from pull-out force. Because the swage K and the main body 10 are integrally formed, the core wire pressure bonded to the conductor swage 31 and the male terminal inserted into the main body 10 are electrically connected.

The spring contact member 20 is a plate spring member made of a plate material having elasticity and conductivity composed of copper, copper alloy and/or the like, and as shown in FIG. 2B, extends toward an opening B from the opening A and presses against and electrically contacts the male terminal inserted into the main body 10. Here, the opening B is an opening provided in the main body 10 on a side opposite the opening A.

Figure 4:
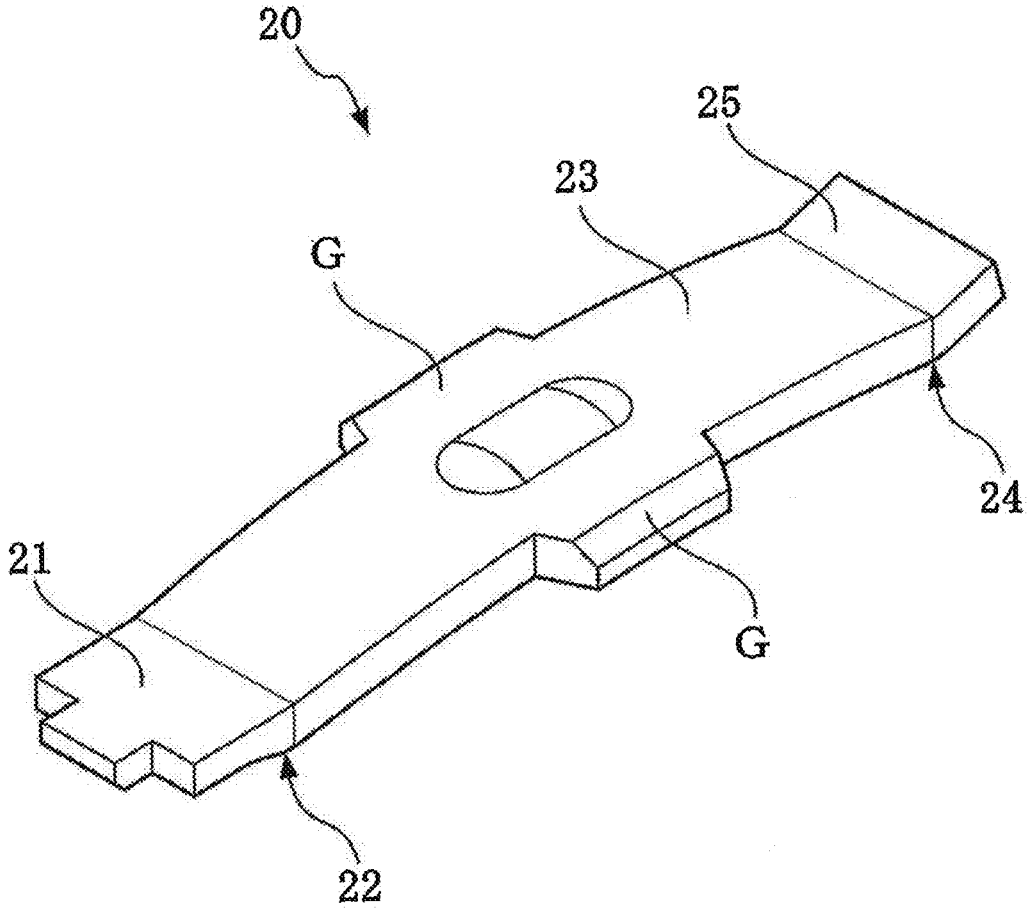
FIG. 4 is an oblique view of a spring contact member shown in FIG. 1.

The spring contact member 20 comprises a first section 21, a first contactor 22, a second section 23, a second contactor 24 and a third section 25, as shown in FIG. 4.

The first section 21 is a section positioned near the opening A of the spring contact member 20, as shown in FIG. 2B. The first section 21 has a shape in which a section facing the bottom plate 11 is removed, is formed thinner than the other sections, is positioned between the bottom plate 11 and the protrusions L1 and L2, and is separated from the bottom plate 11.

The first contactor 22 connects to the first section 21 and contacts the bottom plate 11. The first contactor 22 is such that the section that contacts the bottom plate 11 is bent along the long axis of the spring contact member 20, and linearly contacts the bottom plate 11 so as to be able to slide, at a line orthogonal to the long axis (a line facing the protrusions L1 and L2).

The second section 23 is connected to the first contactor 22, and is formed in an arch shape from the first contactor 22 toward the top plate 12. Near the apex of the second section 23, the wings G protrude on both sides thereof, as shown in FIG. 4. The wings G are received by the holes H provided in the side plates 13 and 14 of the main body 10, as shown in FIG. 3. The wings G are formed with the widths thereof slightly smaller than the widths of the holes H, and control movement of the spring contact member 20 in the direction of insertion and removal of the male terminal.

Returning to FIG. 2B, the second contactor 24 is a bent section positioned at the end of the opening B side of the second section 23, is formed by being bent toward the top plate 12, contacts the bottom plate 11 and supports the second section 23. The second contactor 24 is such that the section that contacts the bottom plate 11 is bent along the long axis of the spring contact member 20, and linearly contacts the bottom plate 11 so as to be able to slide, at a line orthogonal to the long axis.

The third section 25 connects to the second contactor 24, has the same thickness as the second section 23, and is separated from the bottom plate 11 by being formed in a shape that rises up from the bottom plate 11.

Next, movement of the various members when a male terminal is inserted into the female terminal 1 is described with reference to FIGS. 5A~5C.

Figure 5A:
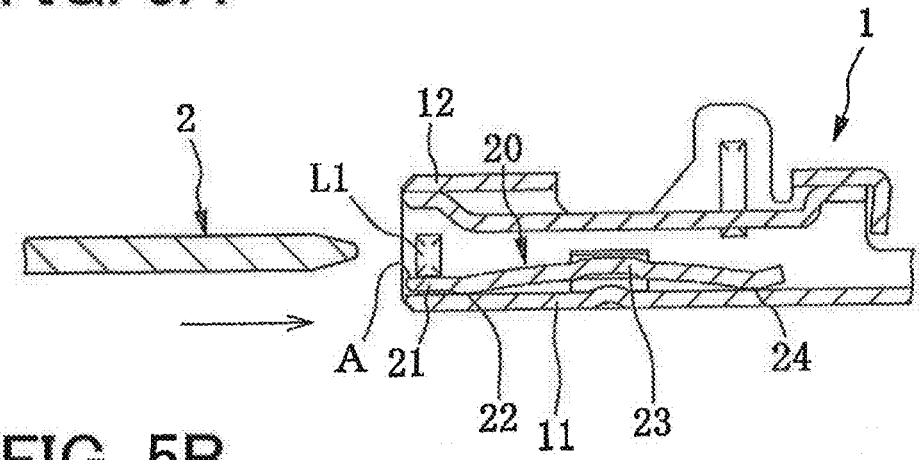
FIGS. 5A~5C are cross-sectional views for describing movement of various members when a male terminal is inserted into the female terminal.
Figure 5B:
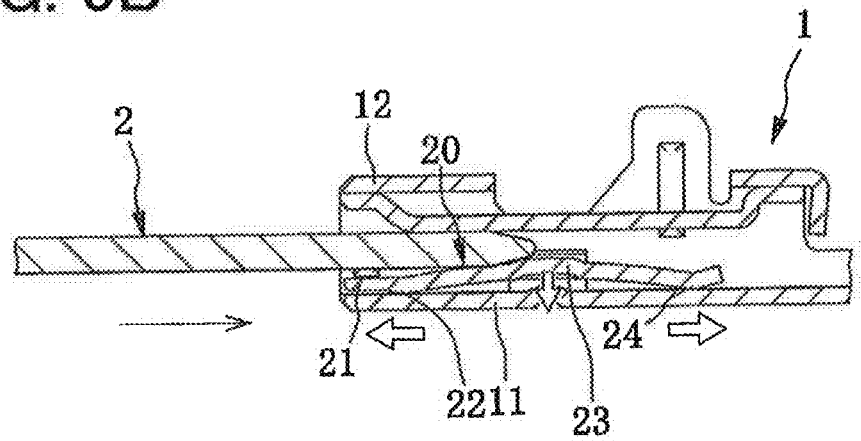

When a male terminal 2 is inserted from the opening A of the main body 10 as shown in FIG. 5A and abuts the second section 23 of the spring contact member 20 as shown in FIG. 5B, the second section 23 begins to bend toward the bottom plate 11. As the male terminal 2 advances, bending of the second section 23 becomes a maximum, as shown in FIG. 5C. Because the wings G protruding near the apex of the second section 23 are received in the holes H in the side plates 13 and 14, as shown in FIG. 3, a portion near the apex of the second section 23 moves only in the downward direction in FIG. 5, without moving in the direction of insertion of the male terminal 2, and bends toward the bottom plate 11. In addition, as shown in FIGS. 5A~5C, when the second section 23 bends, the first contactor 22 and the second contactor 24 slide on the bottom plate 11 in mutually separating directions.

Figure 6A:
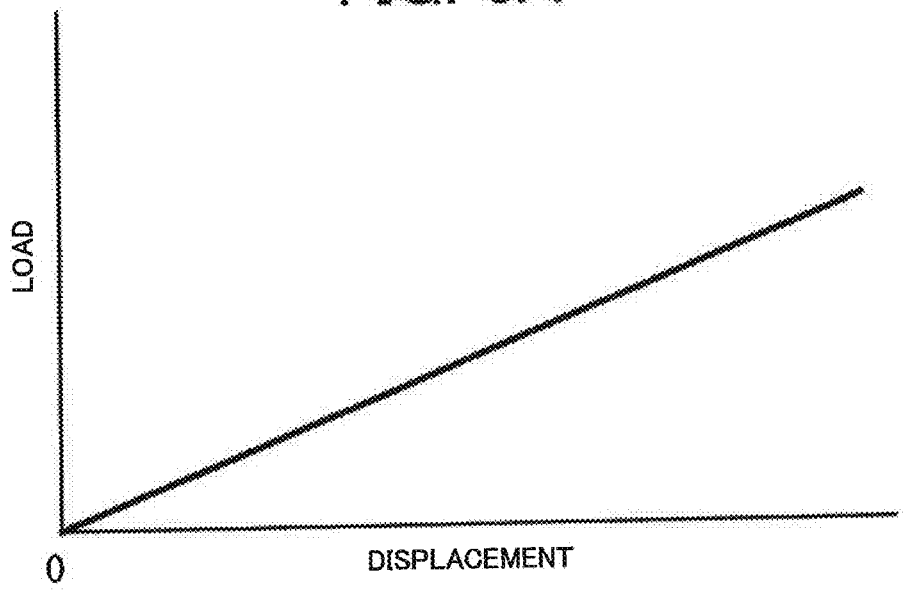
FIG. 6A is a graph expressing a load (spring constant) versus displacement of the spring contact member of the female terminal shown in FIG. 1.

During this, since the first section 21 is apart from the bottom plate 11, even when the second section 23 bends, the first section 21 does not contact the bottom plate 11 and apply tension to the first contactor 22 or the second section 23. Consequently, as shown in FIG. 6A, the spring constant of the spring contact member 20 remains virtually fixed.

Figure 5C:
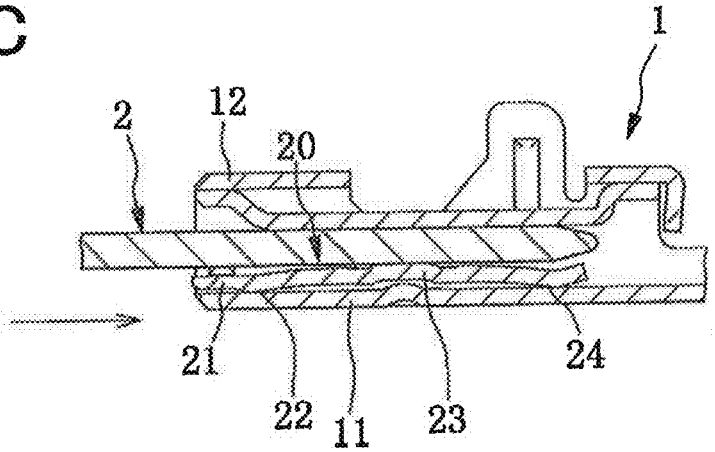

In addition, as shown in FIGS. 5A~5C, the surface of the first section 21 facing the top plate 12 is pressed and stopped by the protrusions L1 and L2 of the side plates 13 and 14. Consequently, it is possible to prevent the first section 21 from rising toward the top plate 12 when the male terminal makes contact with the tip of the spring contact member 20.

In addition, when the male terminal 2 is pulled out, when the tip of the male terminal 2 moves to near the apex of the second section 23, the second section 23 begins to return toward the top plate 12 through the elastic restoration of the spring contact member 20, and when the male terminal 2 separates from the spring contact member 20, the second section 23 returns to the initial position. During this, the first contactor 22 and the second contactor 24 both slide on the bottom plate 11 in mutually approaching directions.

As described above, through the female terminal 1 according to this exemplary embodiment, the spring contact member 20 contacts the bottom plate 11 at the first contactor 22 and the second contactor 24, and the tip section, that is to say the first section 21, does not contact the bottom plate 11. In other words, the contact section and contact surface area in the spring contact member 20 that contact the inner surface of the main body 10 of the female terminal 1 does not change before and after insertion of the male terminal 2. In addition, there is no change through the shape or length of the first section 21. Consequently, stabilizing the pressure of holding the male terminal 2 is possible, and as a result, the male terminal 2 can be held with an appropriate pressure.

Figure 6B:
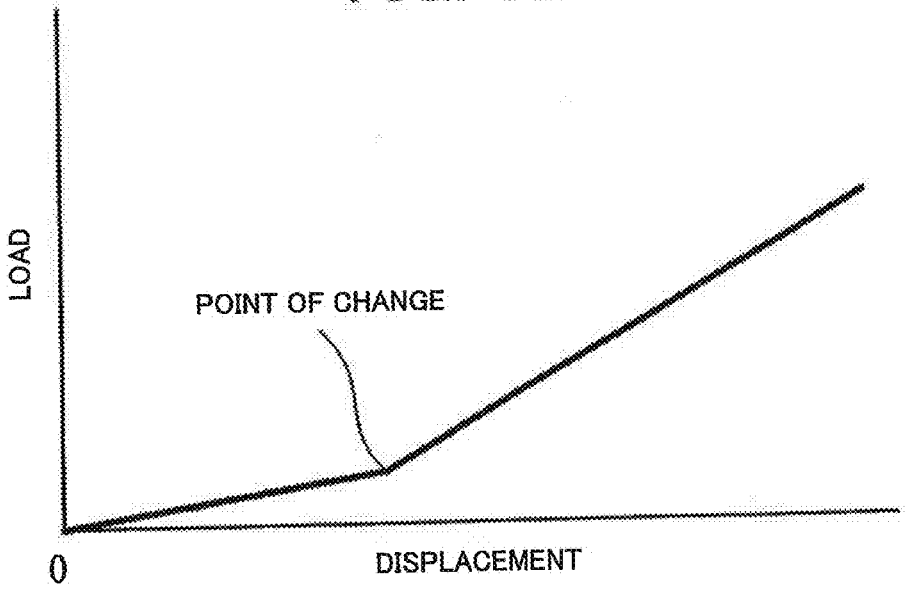
FIG. 6B is a graph showing the load (spring constant) versus displacement of the spring contact member of a female terminal according to a comparison example.
Figure 7A:
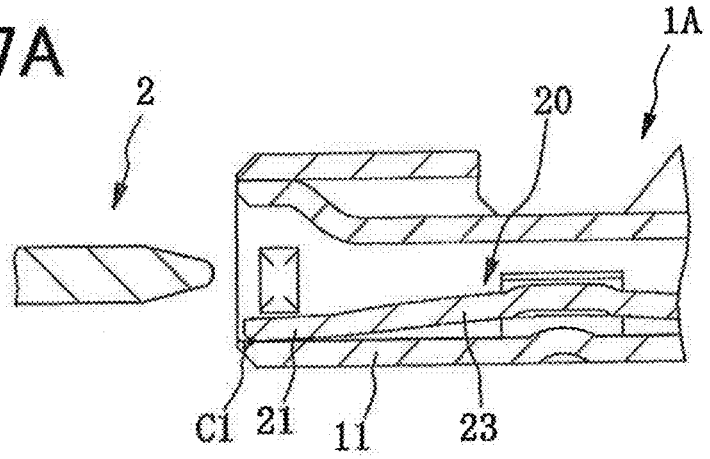
FIG. 7A is a cross-sectional view of a female terminal according to the comparison example.
Figure 7B:
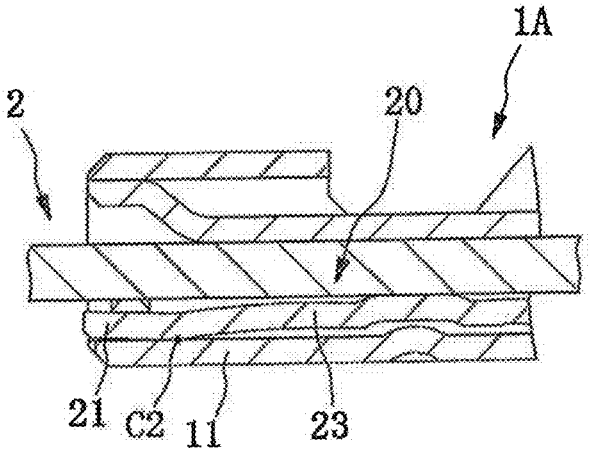
FIG. 7B is a cross-sectional view (part 1) showing a condition of the spring contact member when a male terminal is inserted into the female terminal according to the comparison example.
Figure 7C:
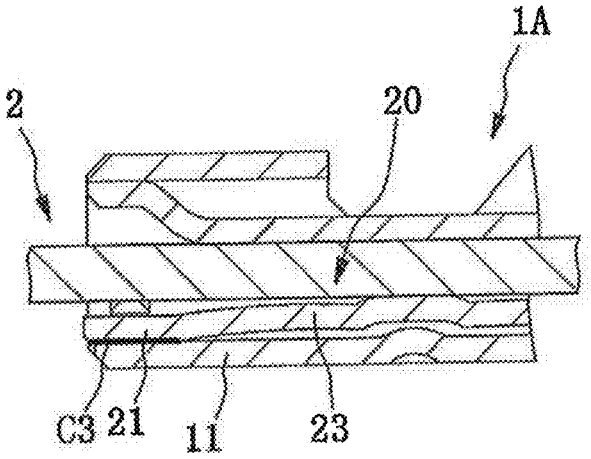
FIG. 7C is a cross-sectional view (part 2) showing a condition of the spring contact member when a male terminal is inserted into the female terminal according to the comparison example.

With a female terminal 1A according to a comparison example shown in FIG. 7A, the tip of a spring contact member 20 contacts a bottom plate 11 (contact point C1). Furthermore, the boundary section between a first section 21 and a second section 23 is separated from the bottom plate 11, and a gap is formed between the boundary section and the bottom plate 11. When a male terminal 2 is inserted into the female terminal 1A according to this comparison example, the section of the spring contact member 20 that contacts the top surface of the bottom plate 11 of the female terminal 1A (the inner surface of a main body 10) changes before and after insertion of the male terminal 2 (contact point C2), as shown in FIG. 7B, and there is concern that the contact surface area (contact surface C3) could change, as shown in FIG. 7C. In addition, as shown in FIG. 6B, the spring constant of the spring contact member 20 is not fixed. Consequently, there is a concern that the pressure holding the male terminal 2 will become unstable.

In contrast, with the female terminal 1 shown in FIG. 5 according to the exemplary embodiment, the pressure holding the male terminal 2 can be stabilized in comparison to the spring contact member 20 of the comparison example in which the tip of the spring contact member 20 is in contact with the bottom plate 11, and as a result, the male terminal 2 can be held with appropriate pressure. In addition, maintaining appropriate electrical contact is possible, so variances in each of the female terminals 1 can be suppressed. Furthermore, in this exemplary embodiment, the pressure holding the male terminal 2 being too low and the reliability of the contact declining or in contrast the pressure holding the male terminal 2 being too high and the insertion force needed for insertion of the male terminal 2 into the female terminal 1 increasing, as in the comparison example, can be prevented.

In addition, the spring contact member 20 according to the exemplary embodiment contacts the main body 10 with the first contactor 22 and the second contactor 24. Unlike the female terminal 1A according to the comparison example, the contact section and the surface area do not receive effects of the pressing pressure of the spring contact member 20. Consequently, there is little fluctuation in electrical properties in individual female terminals 1, and in addition, there is little variance in properties among female terminals 1. Accordingly, obtaining stable electrical properties is possible.

Figure 8:
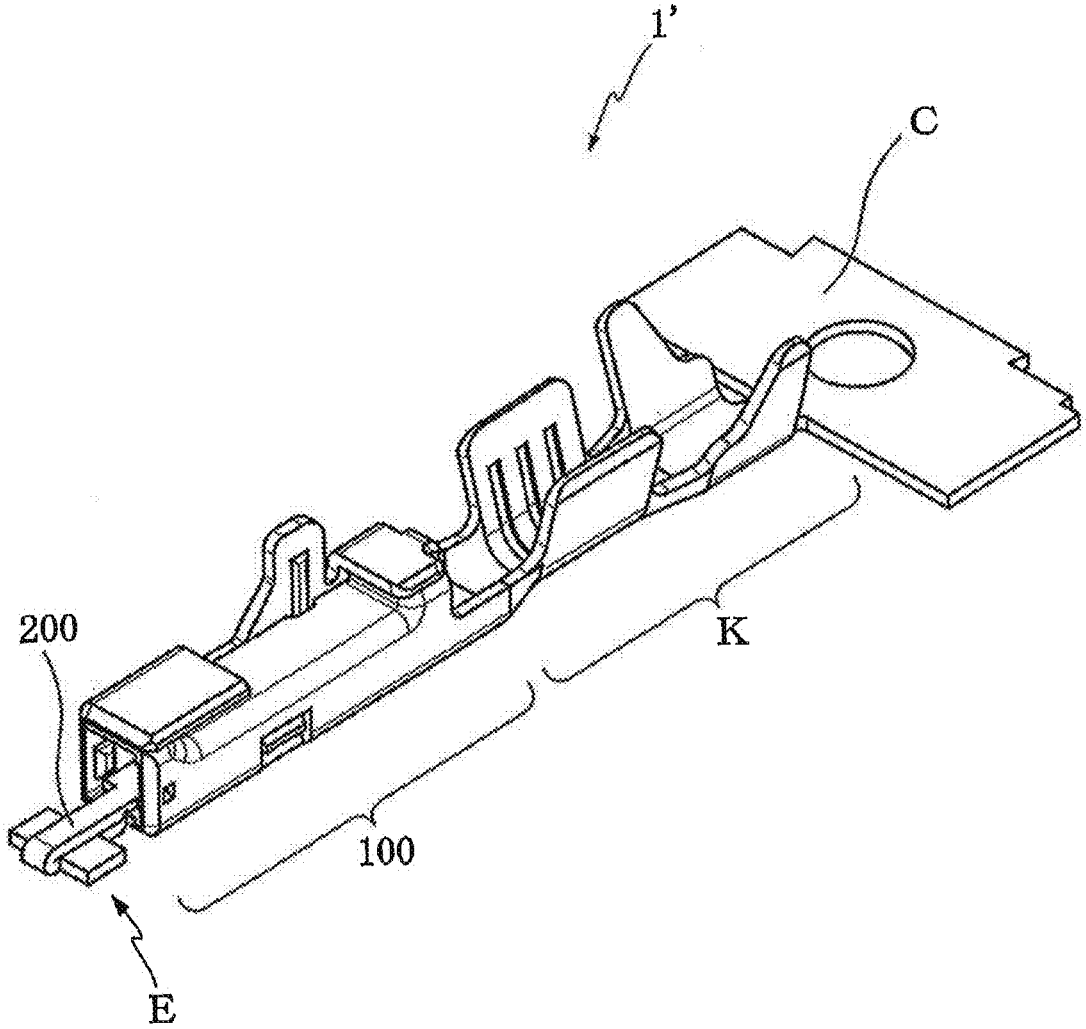
FIG. 8 is an oblique view of the female terminal with carrier attached in a production procedure.

Next, a method of producing the female terminal 1 according to this exemplary embodiment will be described, with reference to FIG. 8 through FIG. 10.

Figure 9:
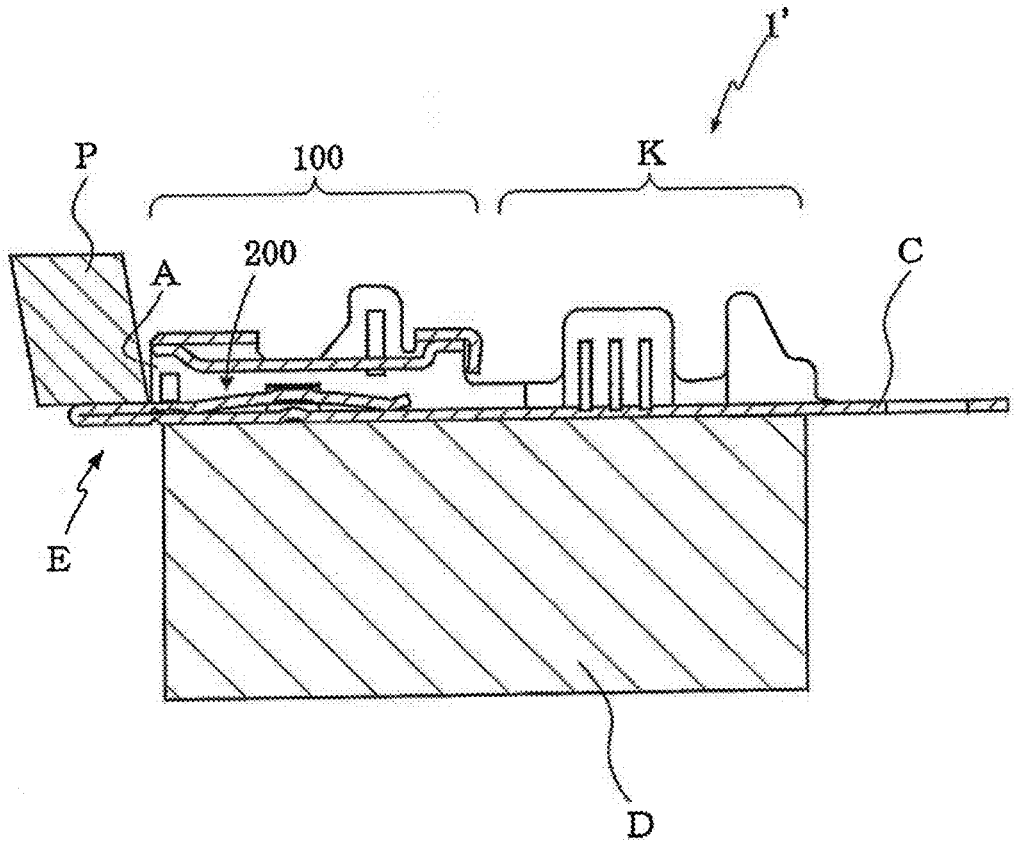
FIG. 9 is a schematic diagram for describing a method of producing the female terminal according to the exemplary embodiment.

The production method of the female terminal 1 according to this exemplary embodiment includes a procedure for forming a terminal in which a single substrate is cut and molded into a predetermined shape (FIG. 8), and a procedure for forming the female terminal 1 by cutting off a portion of a formed substrate 1', as shown in FIG. 9.

In this production method, first a slab-shaped substrate having conductivity and made of copper, copper alloy and/or the like is cut, and a substrate 1' for the female terminal 1 is prepared. The substrate 1' for forming the female terminal 1 is shaped into a shape comprising a plate-shaped section 100 for the main body 10 and a belt-shaped section 200 for the spring contact member 20 extended on one side to the plate-shaped section 100.

Here, the plate-shaped section 100 and the belt-shaped section 200 are flat members having conductivity and made of copper, copper alloy and/or the like.

Figure 10A:
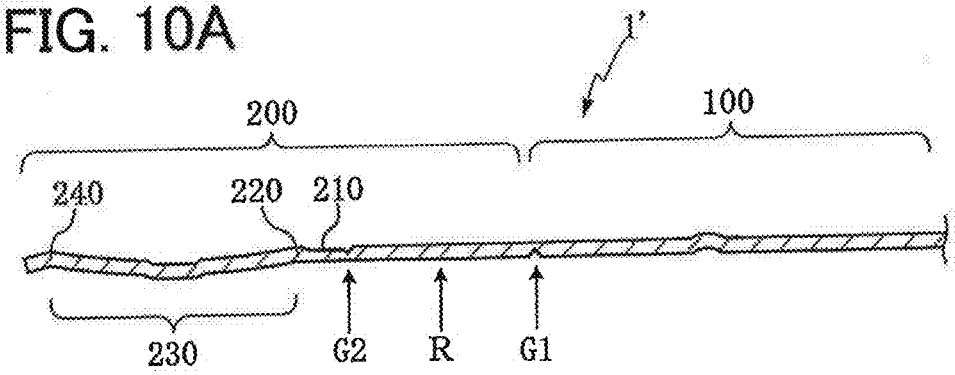
FIG. 10A is a cross-sectional view of a plate-shaped section and belt-shaped section that have been press processed.

When the substrate 1' for forming the female terminal 1 has been prepared, the prepared substrate 1' is set on a press table and undergoes press processing to a shape such as is shown in FIG. 10A. Specifically, a groove G1 is formed near the boundary between the plate-shaped section 100 and the belt-shaped section 200, and a groove G2, a thin plate section 210, a first mountain fold section 220, an arch-shaped section 230 and a second mountain fold section 240 are formed on the belt-shaped section 200.

When processing the substrate 1' in accordance with this production method, ultimately the plate-shaped section 100 becomes the main body 10, the belt-shaped section 200 becomes the spring contact member 20, the thin plate section 210 becomes the first section 21, the first mountain fold section 220 becomes the first contactor 22, the arch-shaped section 230 becomes the second section 23 and the second mountain fold section 240 becomes the second contactor 24.

The groove G1 is formed through press processing of the surface (bottom surface) facing the press table on which the substrate 1' was set and, for example, near the boundary between the plate-shaped section 100 and the belt-shaped section 200. The groove G2 is formed in the surface (top surface) on the side opposite the surface in which the groove G1 is formed, in a section separated from the groove G1 by a predetermined gap toward the tip side of the belt-shaped section 200.

The thin plate section 210 is a section formed with reduced thickness (thinned) through pressing and sinking the top surface of the belt-shaped section 200, in a prescribed segment of the tip side of the belt-shaped section 200 from the groove G2.

The first mountain fold section 220 is a section formed by folding the tip side of the thin plate section 210 (causing the top surface to bend so as to form a convex surface). Here, the first mountain fold section 220 is such that the surface thereof is smoothly curved.

The arch-shaped section 230 is a section formed by shaping the belt-shaped section 200 from the first mountain fold section 220 into an arch shape (causing the bottom surface to bend so as to form a convex surface).

The second mountain fold section 240 is formed by folding a section on the tip side of the arch-shaped member 230. In addition, the first mountain fold section 220 and the second mountain fold section 240 are formed so that the heights thereof are the same degree.

Figure 10B:
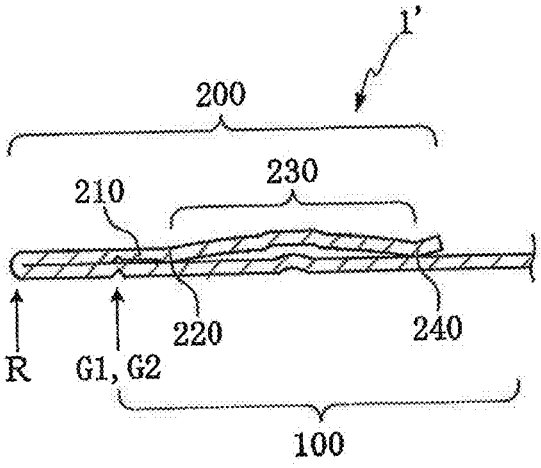
FIG. 10B is a diagram of the condition with the belt-shaped section rotated, as viewed from a side plate side.

When the substrate 1' is press processed into the shape shown in FIG. 10A, next as shown in FIG. 10B, the section of the tip side from a midpoint R of the groove G1 and the groove G2 is caused to rotate in an upward direction about a point near the midpoint R, the groove G1 and the groove G2 are caused to be on top of one another, and the thin plate section 210, the first mountain fold section 220, the arch-shaped member 230 and the second mountain fold section 240 are caused to face the plate-shaped section 100. Then, the first mountain fold section 220 and the second mountain fold section 240 are caused to abut the plate-shaped section 100.

Figure 10C:
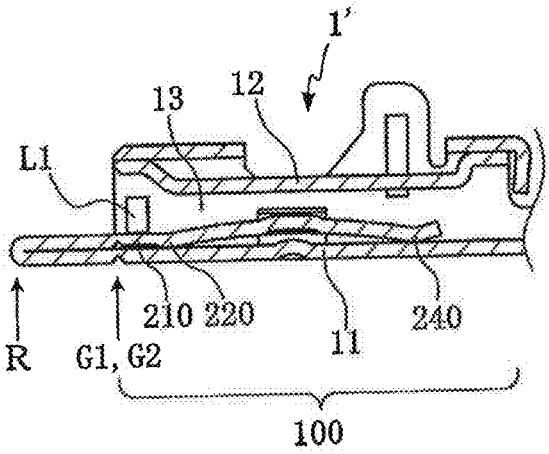
FIG. 10C is a diagram showing a condition of the plate-shaped section formed into a cylindrical shape, as viewed from the side plate side.

When the substrate 1' is processed into the shape shown in FIG. 10B, next the plate-shaped section 100 is formed into a tube shape so that the rotated belt-shaped section 200 is enclosed, as shown in FIG. 10C. The shape of the plate-shaped section 100 formed at this step is arbitrary, and for example may be a square tube shape or may be a cylindrical shape. In this exemplary embodiment, the plate-shaped section 100 is formed into a square tube shape, and is formed so as to comprise the bottom plate 11, the top plate 12, and the side plates 13 and 14.

In addition, at this step the first mountain fold section 220 and the second mountain fold section 240 are caused to support the belt-shaped section 200 on the plate-shaped section 100 so as to be able to slide on the top of the abutting plate-shaped section 100. The method by which the plate-shaped section 100 is caused to support the belt-shaped section 200 is arbitrary. For example, there is a method in which at the point in time when the substrate 1' is cut out, the wings on both sides of the arch-shaped section 230 are cut so as to protrude, holes for receiving the wings are provided in sections facing the wings on the side plates 13 and 14 of the plate-shaped section 100, and when the plate-shaped section 100 is formed in a tube shape, the wings are received into the holes.

As shown in FIG. 10C, when the plate-shaped section 100 is formed into a tube shape, a section E protruding from the opening A of the belt-shaped section 200 is cut off using a punch P and a die D, as shown in FIG. 9. At this time, the grooves G1 and G2 are positioned near the opening A, so little force is needed for the cutting off, and the thin plate section 210 is not readily deformed. In addition, even if the thin plate section 210 is deformed, the thin plate section 210 and the plate-shaped section 100 are positioned separated, so the thin plate section 210 has difficulty contacting the bottom plate 11. Consequently, a fulcrum (contact point C1 shown in FIG. 7A) of the spring contact member 20 is not formed near the opening A, the boundary section between the first section 21 and the second section 23 of the spring contact member 20 does not float, and a gap is not created between the boundary section and the bottom plate 11. As shown in FIG. 9 and FIG. 10C, the spring contact member 20 is such that the first mountain fold section 220 (first contactor 22) becomes the fulcrum on the opening A side, and even when the male terminal 2 is inserted into the main body 10 and the spring contact member 20 bends, the spring constant does not change with the degree of bending, so the contact pressure of the terminal is fixed. Accordingly, the female terminal 1 produced with this production method can reduce variance in contact pressure of the terminals among products, making the variance easily fall within a predetermined range of tolerance.

As shown in FIG. 9, when the substrate 1' is positioned on the die D and the protruding section E is cut off by the punch P, finally a carrier C is cut off and the female terminal 1 is complete.

With this production process, until virtually the completion step, the female terminal 1 can be produced by simply processing one substrate. In addition, at the final cutting procedure, the occurrence of errors in the dimensions, shape, and/or the like of the cut section cannot be avoided; however, as described above, because the first section 21 is thinned and separated from the bottom plate 11, even if an error does occur, there is no effect on the properties of the completed female terminal 1.

The present disclosure is not limited by the above-described exemplary embodiment, for various alternations are possible within the scope of the present disclosure.

In addition, in this exemplary embodiment the explanation was such that the wings G protrude near the apex of the second section 23 and the protruding wings G are received by holes H provided in the side plate 13 and 14, and through this the main body 10 supports the spring contact member 20, but the method of supporting the spring contact member 20 is not limited to this.

For example, the configuration may be such that the wings G protrude at a location other than near the apex of the second section 23. In such a case, the holes H provided in the side plates 13 and 14 are preferably formed in a shape that encloses the track of the wings G arcing to the extent of bending by the second section 23 when the male terminal 2 is inserted.

In addition, in this exemplary embodiment, the explanation was such that the spring contact member 20 is positioned on the bottom plate 11, but the configuration may be such that the spring contact member 20 is positioned on the top plate 12 or the side plates 13 and 14.

In addition, in this exemplary embodiment, the explanation was such that the shape of the surfaces of the first contactor 22 and the second contactor 24 facing the bottom plate 11 was a curved shape, but if these contactors contact the bottom plate 11 so as to be capable of sliding, the shape is not restricted to a curved shape, and for example an edge shape would be fine. In addition, there is no restriction to linear contact, for point contact or surface contact would also be fine.

In addition, the protrusions L1 and L2 may be provided by press processing the side plates 13 and 14, or may be provided by fixing protruding members on the side plates 13 and 14 through crimping and/or the like.

(Variation)

In this exemplary embodiment, a method of producing the female terminal 1 from a substrate 1' in which the plate-shaped section 100 and the belt-shaped section 200 were integrally formed was described, but the female terminal 1 may also be produced by producing the main body 10 and the spring contact member 20 independently and combining such.

Figure 11A:
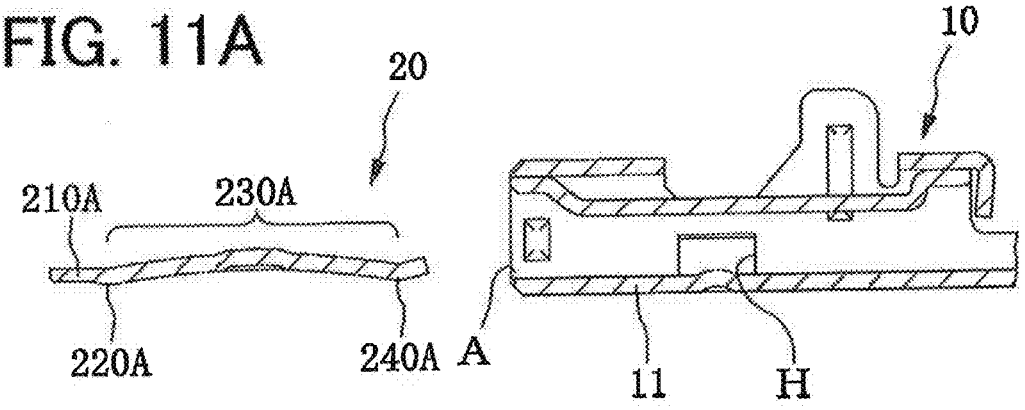
FIG. 11A is a cross-sectional view (part 1) for describing a method of producing a female terminal according to a variation.

In such a case, first, as shown in FIG. 11A, the tube-shaped main body 10 is produced. Next, the spring contact member 20 is produced, comprising a plate-shaped section 210A (thin plate section) in which a portion of one side is lacking, a curved section 220A (first mountain fold section) curved from the end of the plate-shaped section so as to form a convex surface, and an arch-shaped section 230A formed in an arch shape from the curved section 220A.

Figure 11B:
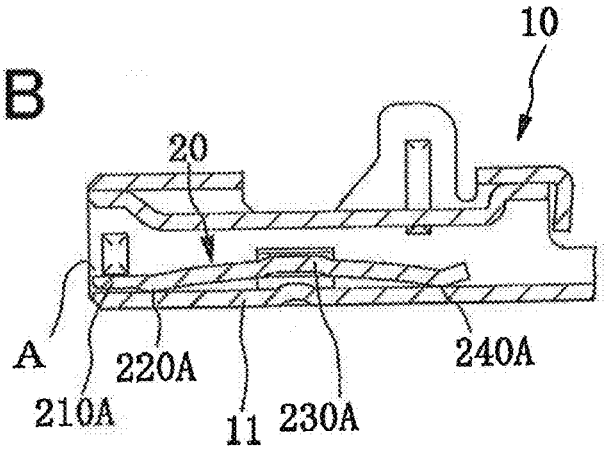
FIG. 11B is a cross-sectional view (part 2) for describing a method of producing a female terminal according to the variation.

Next, as shown in FIG. 11B, the convex surface of the curved section 220A and an end 240A of the arch-shaped section 230A are caused to contact the top surface of the bottom plate 11, so that the one side of the plate-shaped section 210A a portion of which is missing faces the top surface (inside surface of the main body 10) of the bottom plate 11 of the main body 10 near one of the openings A of the tube-shaped main body 10. Finally, the spring contact member 20 is supported on the main body 10, so that the curved section 220A and the end 240A of the spring contact member 20 that contact the bottom plate 11 can slide on the bottom plate 11.

With the production method according to this variation, unlike the comparison example shown in FIG. 7, formation of a female terminal 1 in which only the tip of the spring contact member 20 contacts the bottom plate 11 is easily prevented. However, from the perspective of production costs and/or the like, the above-described exemplary embodiment of forming the female terminal 1 from a single substrate is preferable.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A female terminal comprising:

a conductive, tube-shaped main body; and an elastic contact plate supported inside the main body, possessing conductivity and elasticity, and extending from one opening into which a male terminal is to be inserted, toward another opening;

wherein the elastic contact plate comprises:

a first section that faces a bottom plate inside the main body and is separated from the bottom plate;

a first contactor that is positioned on the other opening side of the first section and contacts the bottom plate;

a second section that extends in an arch shape toward the other opening from the first contactor; and a second contactor that is positioned on the other opening side of the second section and contacts the bottom plate;

wherein the main body supports the elastic contact plate so that the first contactor and the second contactor are able to slide on the bottom plate;

the first section is thinner than the second section and has a hollow surface facing the bottom plate to avoid contact between the first section and the bottom plate during insertion of the male terminal; and the first contactor includes a first contact surface that is a convex surface of a bend between the first section and the second section and that linearly comes into contact with the bottom plate.

2. The female terminal according to claim 1, further comprising:

two wings protruding from both sides near an apex of the second section extending in an arch shape;

wherein in the main body, holes are provided for receiving the protruding two wings.

3. The female terminal according to claim 1, further comprising protrusions disposed near the one opening of the main body and pressing a surface of the first section that does not face the bottom plate in a direction of the bottom plate.

4. The female terminal according to claim 2, further comprising protrusions disposed near the one opening of the main body and pressing a surface of the first section that does not face the bottom plate in a direction of the bottom plate.

* * * * *